US009375069B2

(12) United States Patent
Crawford

(10) Patent No.: US 9,375,069 B2
(45) Date of Patent: Jun. 28, 2016

(54) CONSUMER CARE PACKAGING

(75) Inventor: John C. Crawford, Mahopac, NY (US)

(73) Assignee: Colgate-Palmolive Company, New York, NY (US)

( * ) Notice: Subject to any disclaimer, the term of this patent is extended or adjusted under 35 U.S.C. 154(b) by 310 days.

(21) Appl. No.: 13/981,103

(22) PCT Filed: Feb. 1, 2011

(86) PCT No.: PCT/US2011/023359

§ 371 (c)(1),
(2), (4) Date: Jul. 23, 2013

(87) PCT Pub. No.: WO2012/105963

PCT Pub. Date: Aug. 9, 2012

(65) Prior Publication Data

US 2013/0302079 A1 Nov. 14, 2013

(51) Int. Cl.

| | |
|---|---|
| ***B43K 21/16*** | (2006.01) |
| ***A45D 40/06*** | (2006.01) |
| ***A45D 40/02*** | (2006.01) |
| ***A45D 40/04*** | (2006.01) |
| ***A45D 40/20*** | (2006.01) |

(52) U.S. Cl.

CPC ..... *A45D 40/06* (2013.01); *A45D 40/02* (2013.01); *A45D 40/04* (2013.01); *A45D 40/205* (2013.01)

(58) Field of Classification Search

CPC ..... A45D 40/02; A45D 40/04; A45D 40/06; A45D 40/205

USPC ..... 401/68, 86, 87

See application file for complete search history.

(56) References Cited

U.S. PATENT DOCUMENTS

| | | | | | |
|---|---|---|---|---|---|
| 3,091,329 | A * | 5/1963 | Levine | A45D 40/06 | 401/117 |
| 4,180,163 | A * | 12/1979 | Grioni | A45D 40/06 | 206/385 |
| 5,234,136 | A * | 8/1993 | Kopis | 222/391 | |
| 5,800,086 | A | 9/1998 | Piscopo et al. | | |
| 5,829,900 | A * | 11/1998 | Brown et al. | 401/88 | |
| 5,829,901 | A * | 11/1998 | Brown et al. | 401/87 | |
| 5,988,919 | A * | 11/1999 | Kuo | A45D 40/02 | 401/102 |
| 6,561,711 | B1 * | 5/2003 | Pierpont | A45D 40/06 | 401/192 |
| 6,918,511 | B1 | 7/2005 | Spatz et al. | | |
| 7,021,849 | B2 * | 4/2006 | Ramet | 401/176 | |

(Continued)

FOREIGN PATENT DOCUMENTS

| | | |
|---|---|---|
| EP | 1 428 455 | 6/2004 |
| EP | 1 857 014 | 11/2007 |

(Continued)

OTHER PUBLICATIONS

CO Examination Report for corresponding CO Appl. No. 13-179.958 mailed Sep. 12, 2014. CO.

(Continued)

*Primary Examiner* — Jennifer C Chiang

(57) ABSTRACT

A package for a consumer care composition including a container having a base, a solid stick of a consumer care composition supported on the base, an annular sleeve surrounding the solid stick, the annular sleeve being coupled to the base by a coupling mechanism, the coupling mechanism being adapted to control longitudinal movement of the annular sleeve relative to the base between extended and refracted positions.

21 Claims, 10 Drawing Sheets

(56) References Cited

U.S. PATENT DOCUMENTS

| | | | | |
|---|---|---|---|---|
| 8,132,977 | B2 * | 3/2012 | Pires et al. | 401/88 |
| 2007/0160412 | A1 | 7/2007 | Cummings et al. | |

FOREIGN PATENT DOCUMENTS

| | | | |
|---|---|---|---|
| FR | 2517941 | | 6/1983 |
| FR | 2517941 | A1 * | 6/1983 |
| GB | 710 934 | | 6/1954 |

OTHER PUBLICATIONS

International Search Report and Written Opinion of the International Searching Authority in International Application No. PCT/US2011/023359 mailed May 7, 2012.

* cited by examiner

CONSUMER CARE PACKAGING

FIELD OF THE INVENTION

The present invention relates to stick dispensers for consumer care compositions.

BACKGROUND OF THE INVENTION

It is well known to provide a variety of different stick dispensers for consumer care compositions such as antiperspirant compositions, deodorant compositions, lip sticks, oral care compositions, and the like. Such a consumer care composition is in solid stick form. The stick is mounted within a housing and an externally actuatable screw mechanism is coupled to a carrier at the base of the stick for progressively advancing the stick out of the housing. As the stick is progressively consumed by rubbing a free end surface of the stick against the skin, the free end surface of the stick can be maintained outside of the housing for subsequent application by advancing the stick using the screw mechanism to advance the carrier.

One problem with such known packages is that the screw mechanism requires a number of components, which increases the cost and complexity of manufacturing the package. For example, a typical package requires a threaded riser, a screw shaft, a turning knob, and a snap-in base. In addition, the manufacturing and assembly process can be rather complicated. During manufacture, the composition is poured into the package as a liquid, which is then permitted to gel and solidify. The package also comprises an upper sealing plug to contain the liquid product within the package when it is in liquid form during manufacture.

There is a need in the art for a package for a consumer care composition which provides a more simple advancement mechanism and action to enable the user readily to achieve manual control of the sick advancement by the user and easier application to desired areas of the skin.

There is also a need in the art for a package for a consumer care composition which has a low number of components and is easy to manufacture.

There is furthermore a need in the art for a package for a consumer care composition which can be manufactured at a lower cost than known packages.

BRIEF SUMMARY OF THE INVENTION

The present invention provides a package for a consumer care composition, the package comprising a container containing a consumer care composition in the form of a solid stick, the container having a base, a solid stick of the consumer care composition supported on the base, an annular sleeve surrounding the solid stick, the annular sleeve being coupled to the base by a coupling mechanism, the coupling mechanism being adapted to control longitudinal movement of the annular sleeve relative to the base between extended and retracted positions.

Optionally, in some embodiments the annular sleeve is longitudinally movable relative to the base by rotation of the annular sleeve. For example, the coupling mechanism may comprise a threaded connection between the annular sleeve and the base. Typically, the threaded connection comprises a male thread provided on an exterior surface of the annular sleeve and a female thread provided on an internal surface of the base. The package may further comprise a grip enhancing exterior surface of the annular sleeve.

Alternatively, in other embodiments the annular sleeve is longitudinally movable relative to the base by longitudinal sliding translation of the annular sleeve. Optionally the coupling mechanism comprises at least one ratchet mechanism between the annular sleeve and the base. The at least one ratchet mechanism may comprise a resilient member on the base and a plurality of slots on an exterior surface of the annular sleeve, the resilient member being selectively locatable in a respective one of the plurality of slots. The plurality of slots may be oriented along a longitudinally directed line. Optionally, in some embodiments the package comprises two opposed ratchet mechanisms. The two opposed ratchet mechanisms may be on opposite sides of the package, which typically has an oval cross-section, or alternatively on opposite major surfaces of the package, which typically has an oval cross-section.

Optionally, in some embodiments the resilient member comprises an upwardly oriented resilient plate located at an upper edge of the base, the plate having a free end for interlocking with a respective slot and being connected to the base by a living hinge.

Optionally, in some embodiments the base includes a cavity for receiving the sleeve in the retracted position. The cavity may be an annular cavity between the base and an inner part.

Optionally, in some embodiments the base comprises a transverse wall on which the solid stick is mounted. The transverse wall may be porous and disposed above a central cavity within the base.

The package may further comprise a plug sealing the bottom of the central cavity.

The consumer care composition may include a fragrance, and the package may further comprise at least one selectively openable conduit communicating with a region including the consumer care composition. Optionally, the at least one selectively openable conduit communicates with a central cavity in the base beneath the consumer care composition. Optionally, the at least one selectively openable conduit is temporarily sealed by a removable pressure-sensitive self-adhesive label adhered thereover.

Optionally, the consumer care composition is an antiperspirant composition and/or a deodorant composition.

The present invention further provides a package for a consumer care composition, the package comprising a container containing a consumer care composition in the form of a solid stick, the container having a base which comprises a transverse wall on which the solid stick is mounted, the transverse wall being porous and disposed above a central cavity within the base, the central cavity being surrounded by an inner side wall of the base, the base further comprising an outer side wall defining an annular cavity between the outer side wall and the inner side wall, a sleeve surrounding the solid stick, the sleeve being longitudinally movable relative to the base between extended and retracted positions, the sleeve being retractable into the annular cavity.

Optionally, the package further comprises a plug sealing the bottom of the central cavity.

Optionally, the consumer care composition includes a fragrance, and the package further comprises at least one selectively openable conduit communicating with the central cavity. The at least one selectively openable conduit may be temporarily sealed by a removable pressure-sensitive self-adhesive label adhered thereover.

Optionally, in some embodiments the package further comprises a cap fitted to the base. The container may optionally consist of three moulded plastic components of the base, the sleeve and the cap in combination with the solid stick.

Alternatively, the container may optionally consist of four moulded plastic components of the base, a plug for sealing a bottom of the baser, the sleeve and the cap in combination with the solid stick.

There is further disclosed a method of manufacturing a package comprising a container containing a consumer care composition in the form of a solid stick. The method comprises the steps of: providing a container having a base which comprises a porous transverse wall, a sleeve extending from the base, the sleeve being longitudinally movable relative to the base between extended and retracted positions, and a cap fitted to the base around the sleeve, an inner end surface of the cap and an inner surface of the sleeve defining a void adjacent to the porous transverse wall; disposing the container in an inverted orientation; filling the void with a consumer care composition in liquid form, the liquid passing downwardly through the porous transverse wall; and allowing the consumer care composition to solidify to form a solid stick.

Optionally, in some embodiments the solid stick is moulded to the porous transverse wall. The method may further comprise sealing the base by a sealing plug.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
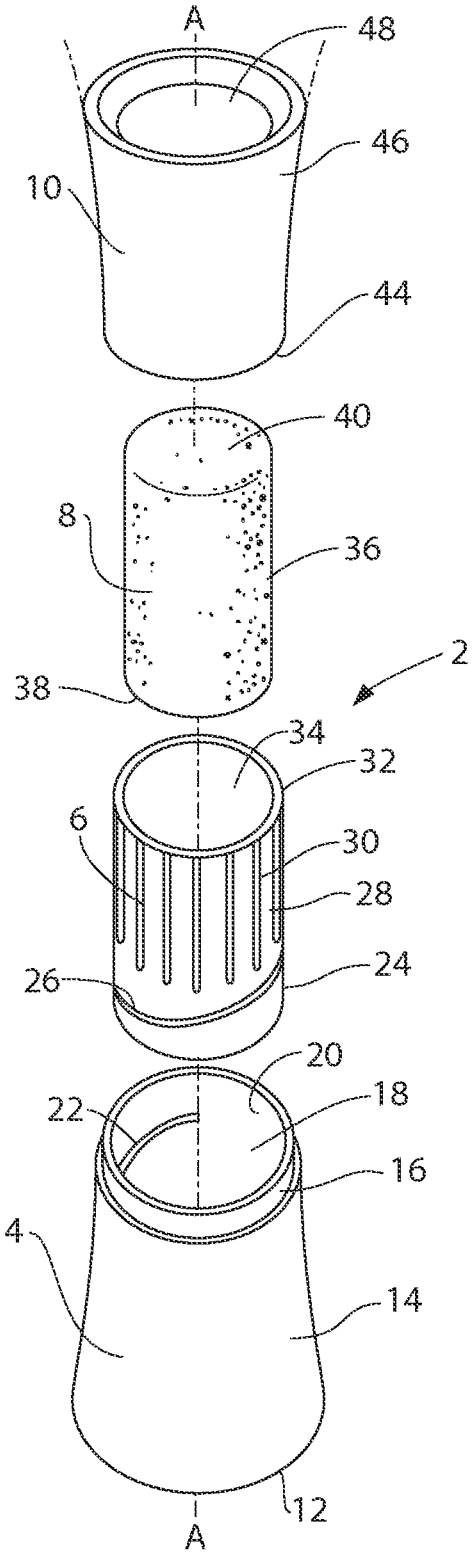
FIG. 1 schematically illustrates an exploded perspective view of a package for a consumer care composition in accordance with a first embodiment of the present invention.

The following description of the preferred embodiment(s) is merely exemplary in nature and is in no way intended to limit the invention, its application, or uses.

The following definitions and non-limiting guidelines must be considered in reviewing the description of this invention set forth herein. The headings (such as "Background of the Invention" and "Brief Summary of the Invention,") used herein are intended only for general organization of topics within the disclosure of the invention, and are not intended to limit the disclosure of the invention or any aspect thereof. In particular, subject matter disclosed in the "Background of the Invention" may include aspects of technology within the scope of the invention, and may not constitute a recitation of prior art. Subject matter disclosed in the "Brief Summary of the Invention" is not an exhaustive or complete disclosure of the entire scope of the invention or any embodiments thereof.

The citation of references herein does not constitute an admission that those references are prior art or have any relevance to the patentability of the invention disclosed herein. Any discussion of the content of references cited in the Background of the Invention is intended merely to provide a general summary of assertions made by the authors of the references, and does not constitute an admission as to the accuracy of the content of such references. Each and every reference cited herein is hereby incorporated by reference in its entirety.

The detailed description, while indicating embodiments of the invention, is intended for purposes of illustration only and is not intended to limit the scope of the invention. Moreover, recitation of multiple embodiments having stated features is not intended to exclude other embodiments having additional features, or other embodiments incorporating different combinations of the stated of features.

As used herein, the words "preferred" and "preferably" refer to embodiments of the invention that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the word "include," and its variants, is intended to be non-limiting, such that recitation of items in a list is not to the exclusion of other like items that may also be useful in the dispensers of this invention.

FIGS. 1 to 5 schematically illustrate a package, designated generally as 2, for a consumer care composition in accordance with a first embodiment of the present invention.

Referring in detail to FIGS. 1 to 5, the package 2 is a solid stick dispenser for a consumer care composition such as an antiperspirant composition and/or a deodorant composition. An annular base 4 is substantially cylindrical and contains a substantially cylindrical annular sleeve 6 which surrounds a substantially cylindrical solid stick 8 of the consumer care composition. The upper end of the stick 8 is covered by a cap 10 which is releasably attached to the base 4.

The stick 8 is mounted to the base 4 at a fixed longitudinal position, but the sleeve 6 can be moved longitudinally relative to both the base 4 and the stick 8. The sleeve 6 can be moved continuously. The sleeve 6 is coupled to the base 4 by a movable coupling mechanism and manually advanced or retracted, as desired, to reveal or conceal the stick 8. As the stick 8 is progressively consumed by wearing away of the upper surface of the stick 8 against the skin after successive applications of the consumer care composition to the user, the sleeve 6 can be correspondingly retracted to reveal more of the stick 8. The cap 10 can be fitted over the sleeve 6 and the stick 8 and fitted to the base 4 in order to close and seal the package 2, and thereby protect the stick 8 when not in use, irrespective of the longitudinal position of the sleeve 6 relative to the base 4 and the height of the remaining portion of the stick 8.

The base 4 has a bottom wall 12 on which the package 2 can stand upright when placed on a surface. The base 4 has an annular side wall 14 extending upwardly from the bottom wall 12, the side wall 14 having an annular upper edge 16 for releasable engagement with an annular lower edge 44 of the cap 10. For example, a threaded or snap-fitting coupling may be provided between the upper edge 16 of the base 4 and the lower edge 44 of the cap 10. The side wall 14 has a longitudinally extending substantially cylindrical annular inner surface 20.

The inner surface 20 of the side wall 14 is provided with a first helical thread 22, preferably a female thread. An outer circumferential surface 24 of the lower end of the sleeve 6 is provided with a second helical thread 26, preferably a male thread. The first and second helical threads 22, 26 are coupled together so that rotation of the sleeve 6 about a longitudinal axis A, as shown by the arrow R, causes the sleeve 6 to be continuously advanced from or retracted within the base 4 depending upon the direction of rotation. The outer circumferential surface 28 of the upper end of the sleeve 6 is provided with an annular array of longitudinally oriented grooves 30 to enhance manual grip on the surface 28.

Figure 3:
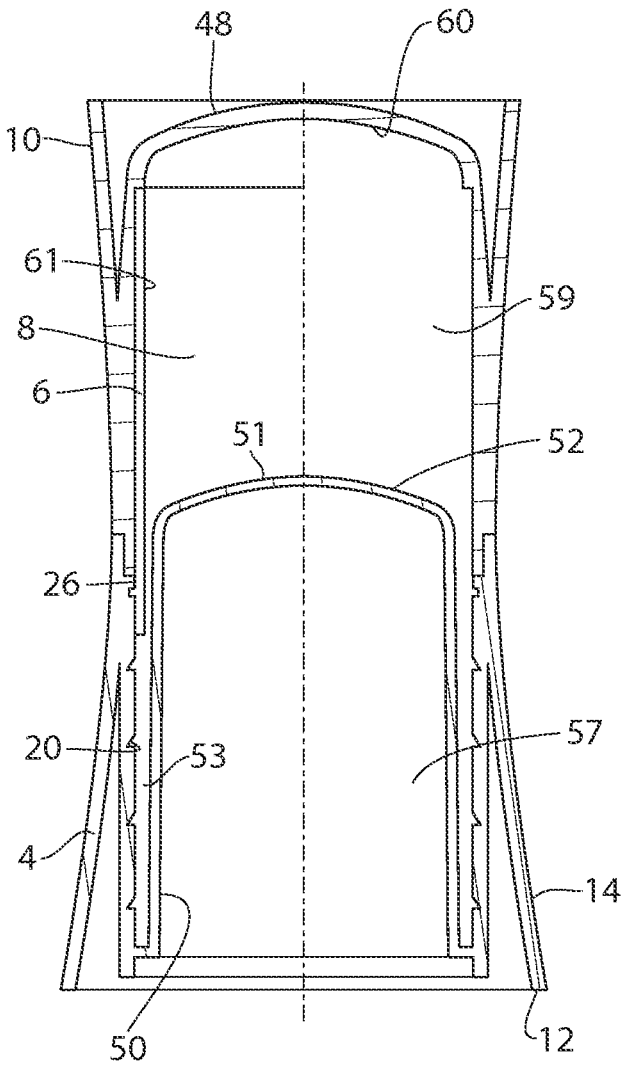
FIG. 3 schematically illustrates a section through the assembled package of FIG. 1.

The sleeve has an upper edge 32 and an inner circumferential surface 34. The stick 8 of the solid consumer care composition is cylindrical and fits snugly within the sleeve 6, with the outer circumferential surface 36 of the stick 8 either slightly spaced from, or in contact with and slidable against, the inner circumferential surface 34 of the sleeve 6. The bottom end 38 of the stick 8 is disposed on an upper transverse wall 52 of a base inner part 50 which is located within the base 4, as shown in FIG. 3. The base inner part 50 and base 4 are preferably commonly moulded of a plastic material and integral and define therebetween an annular cavity 53 into which the retracted sleeve 6 is received.

The upper end 40 of the stick 8 is covered by the cap 10 when the product is not in use. The cap 10 has the lower edge 44 which mates with the upper edge 16 of the base 4, a sidewall 46 extending upwardly from the lower edge 44 and a top wall 48 sealing the package 2.

Figure 2:
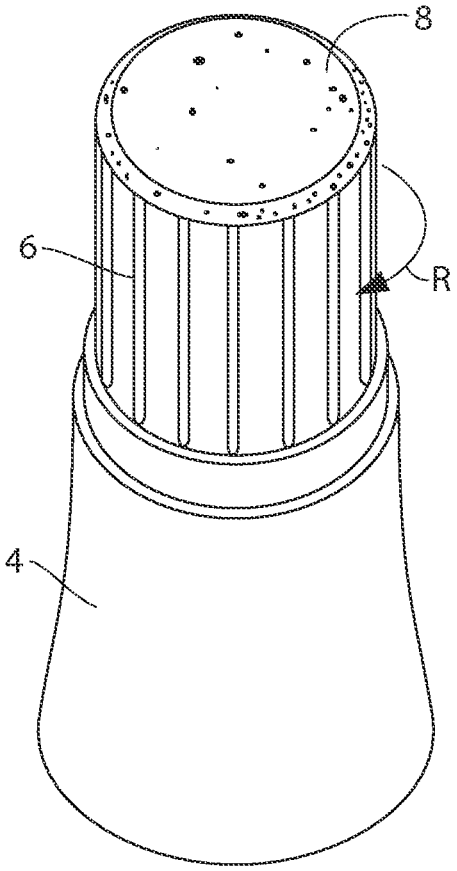
FIG. 2 schematically illustrates a perspective view of the assembled package, without the cap thereof, of FIG. 1.

As shown in FIG. 2, after the cap 10 has been removed 4 to expose the upper end 40 of the stick 8, the sleeve 6 can be rotated so as to be retracted within the base 4. Therefore, a working exposed upper portion of the stick 8 can be selectively exposed for use by rotating the sleeve 6 in a first direction, and then subsequently covered after use by rotating the sleeve 6 in a second opposite direction. As the stick 8 is progressively consumed, the sleeve 6 is progressively received within the annular cavity 53 of the base 4. The sleeve 6 retracts within the annular cavity 53 between the inner surface 20 of the side wall 14, or an extension thereof, and the base inner part 50. In FIG. 3 the left hand side shows the sleeve 6 fully extended out of the base 4 and the right hand side shows the sleeve 6 fully retracted within the base 4.

The upper transverse wall 52 of base inner part 50 is porous and provided with holes 51 therethrough to permit the consumer care composition when in liquid form to flow through the upper wall 52. The upper wall 52 is located above a central cavity 57 in the base inner part 50.

Figure 4:
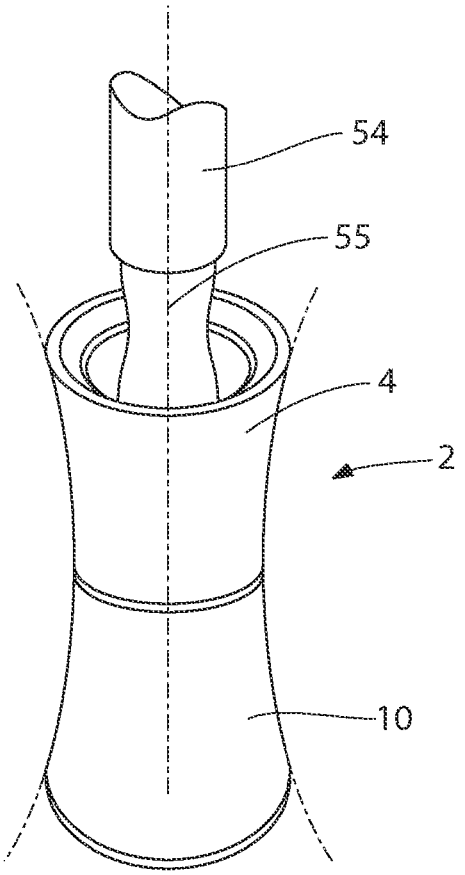
FIG. 4 schematically illustrates the package of FIG. 1 when inverted and during a filling step in which the package is filled with consumer care composition in liquid form.
Figure 5:
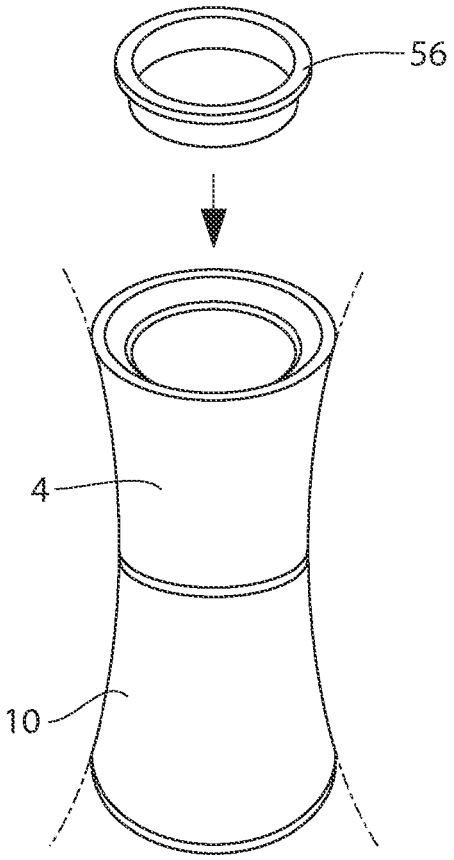
FIG. 5 schematically illustrates the application of a post-filling plug to seal the package of FIG. 1 after the filling step of FIG. 4.

As shown in FIGS. 4 and 5, during manufacture the base 4, including base inner part 50, sleeve 6 in extended position and cap 10 are assembled together and held in an inverted orientation. Then a measured dose of the required volume of the consumer care composition is injected in liquid form 55 through a nozzle 54 downwardly into the central cavity 57 of base inner part 50. The liquid flows downwardly through the holes 51 in the upper wall 52 and into a void 59 adjacent to the upper wall 52 and defined by an inner end surface 60 of the cap 10 and extended inner surface 61 of the sleeve 6. The liquid then gels on cooling to form the solid stick 8. The solid stick 8 is moulded to the upper transverse wall 52. A post-filling plug 56 is typically fitted within the base inner part 50 to seal the base 4 of the package 2.

The base may be fitted with an integral bottom wall which obviates the need for an additional plug. When the plug is absent, the container can consist of three moulded plastic components of the base, the sleeve and the cap in combination with the solid stick. Alternatively, when the plug is present, the container can consist of four moulded plastic components of the base, a plug for sealing a bottom of the baser, the sleeve and the cap in combination with the solid stick. This is a lower number of moulded plastic components as compared to known antiperspirant/deodorant stick packages.

Figure 6:
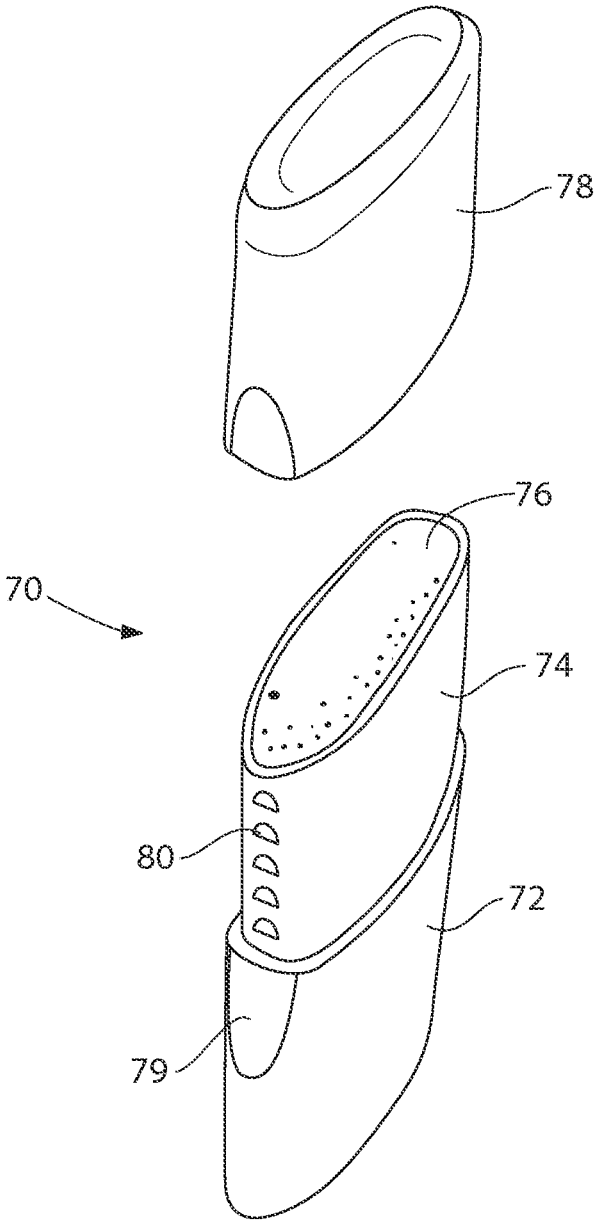
FIG. 6 schematically illustrates an exploded perspective view of a package for a consumer care composition in accordance with a second embodiment of the present invention.
Figure 7:
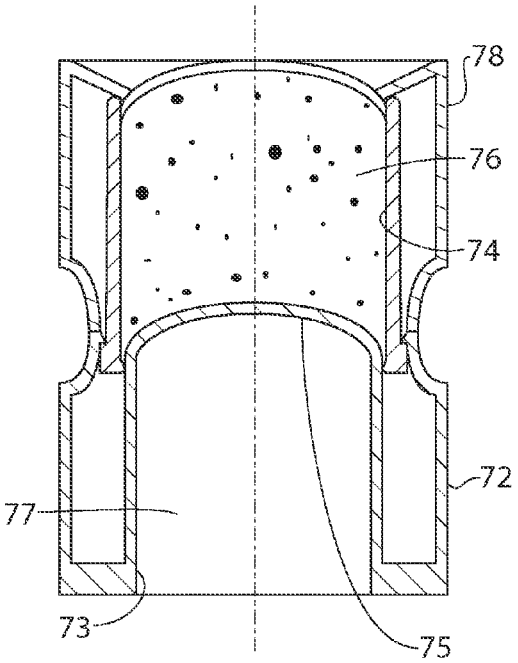
FIG. 7 schematically illustrates a section through the assembled package of FIG. 6.
Figure 8:
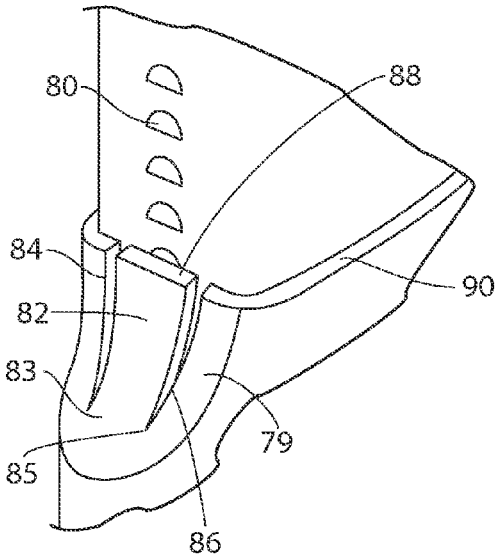
FIG. 8 schematically illustrates in greater detail a ratchet mechanism in the package of FIG. 6 for maintaining the stick at a desired advanced position.
Figure 9:
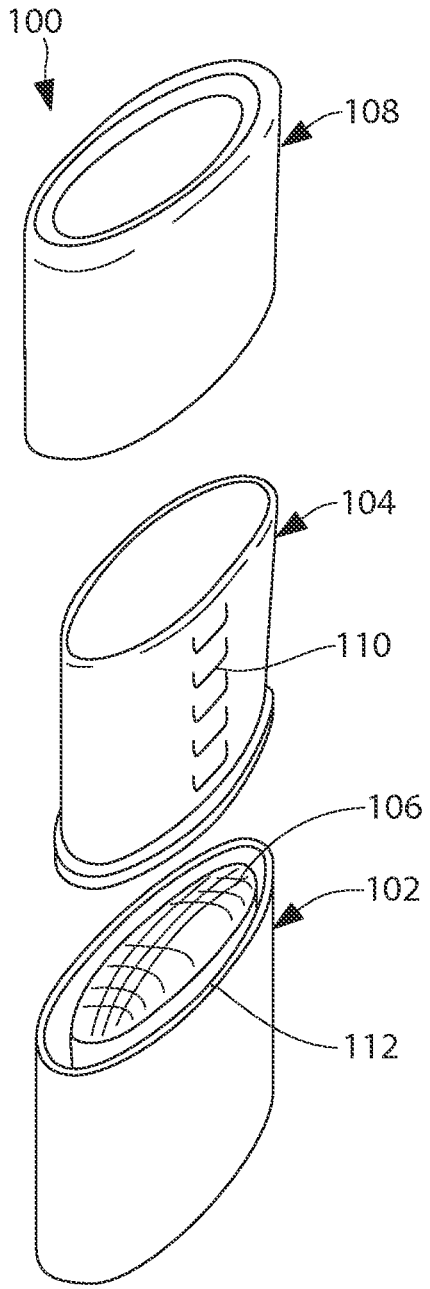
FIG. 9 schematically illustrates an exploded perspective view of a package for a consumer care composition in accordance with a third embodiment of the present invention.

FIGS. 6 to 8 schematically illustrate a package, designated generally as 70, for a consumer care composition in accordance with a second embodiment of the present invention which is a modification of the first embodiment by having a different shape and a different sleeve retraction control and coupling mechanism.

Referring in detail to FIGS. 6 to 8, the package 70 is a solid stick dispenser for a consumer care composition such as an antiperspirant composition and/or a deodorant composition. An annular base 72 is substantially oval in cross-section and contains a substantially oval annular sleeve 74 which surrounds a substantially oval solid stick 76 of the consumer care composition. The upper end of the stick 76 is covered by a cap 78 which is releasably attached to the base 72.

The stick 76 is mounted to the base 72 at a fixed longitudinal position, but the sleeve 74 can be moved longitudinally relative to both the base 72 and the stick 76. The sleeve 74 can be moved step-wise in an indexed manner. The sleeve 74 is coupled to the base 72 by a movable coupling mechanism and manually advanced or retracted, as desired, to reveal or conceal the stick 76. As the stick 76 is progressively consumed by wearing away of the upper surface of the stick 76 against the skin after successive applications of the consumer care composition to the user, the sleeve 74 can be correspondingly retracted to reveal more of the stick 76. The cap 78 can be fitted over the sleeve 74 and the stick 76 and coupled to the base 72 in order to close and seal the package 70, and thereby protect the stick 76 when not in use, irrespective of the longitudinal position of the sleeve 74 relative to the base 72 and the height of the remaining portion of the stick 76.

The base 72 has on each opposite side a respective ratchet mechanism 79 which engages with a longitudinally oriented series of horizontal slots 80 provided in an adjacent side of the sleeve 74. The slots are typically closed grooves. The ratchet mechanism 79 comprises a resilient plate 82, integral with the base 72, disposed between two spaced upright slits 84, 86 extending downwardly from the upper edge 90 of the base 72. The upwardly oriented plate 82 has a free upper end 88 and the lower end 83 is connected to the remainder of the base 72 by a living hinge 85. The ratchet mechanisms 79 restrict downward movement of the sleeve 74 against the spring bias force of the upper ends 88 of the resilient plates 82 which are each received within respective opposed slots 80.

When a user wishes to retract the sleeve, for the reasons described with respect to the first embodiment, the sleeve 74 can be pushed manually downwardly against the resistance of the opposed ratchet mechanisms 79 and then located at a desired retracted position to expose the required height of the stick 76. The opposed free upper ends 88 of the resilient plates 82 are received within respective opposed slots 80 of the sleeve 74 so that the ratchet mechanisms 79 support the sleeve 74 at the desired indexed height during use. If desired, downward movement of the sleeve 74 can be assisted by manual inward pushing of the front and rear major surfaces of the base 72 in the region of the upper edge 90 which tends to cause the free upper ends 88 of the resilient plates 82 to be urged outwardly of the respective opposed slots 80 of the sleeve 74 and therefore temporarily reduce or eliminate the ratchet resistance during downward movement of the sleeve 74. The sleeve 74 can readily be raised manually to a desired extended position to protect the stick 76, the ratchet mechanisms 79 readily permitting upward movement of the sleeve 74 with minimum resistance force.

The package 70 can be inverted and filled with liquid a measured dose of the required volume of the consumer care composition during manufacture in the same manner as described with respect to the first embodiment. The base inner part 73 has a porous upper wall 75 through which liquid consumer care composition can flow after being injected into the central cavity 77 of the base inner part 73 from a nozzle. Subsequently, as for the first embodiment a plug (not shown) may be fitted to the base 72 to seal the central cavity 77.

In a modified embodiment, only a single ratchet mechanism is provided at one side of the package.

FIGS. 9 to 12 schematically illustrate a package, designated generally as 100, for a consumer care composition in accordance with a third embodiment of the present invention which is a modification of the second embodiment by having a modified ratchet mechanism for sleeve retraction control at each of the front and rear major surfaces, rather than at the sides, of the package.

Referring in detail to FIGS. 9 to 12, the package 100 is a solid stick dispenser for a consumer care composition such as an antiperspirant composition and/or a deodorant composition. Like the second embodiment, an annular base 102 is substantially oval in cross-section and contains a substantially oval annular sleeve 104 which surrounds a substantially oval solid stick 106 of the consumer care composition. The upper end of the stick 106 is covered by a cap 108 which is releasably attached to the base 102. The stick 76 is mounted to the base 102 at a fixed longitudinal position, but the sleeve 104 can be moved longitudinally relative to both the base 102 and the stick 106. The sleeve 104 is coupled to the base 102 by a movable coupling mechanism and be manually advanced or retracted, as desired, to reveal or conceal the stick 106. As the stick 106 is progressively consumed by wearing away of the upper surface of the stick 106 against the skin after successive applications of the consumer care composition to the user, the sleeve 104 can be correspondingly retracted to reveal more of the stick 106. The cap 108 can be fitted over the sleeve 104 and the stick 106 and coupled to the base 102 in order to close and seal the package 100, and thereby protect the stick 106 when not in use, irrespective of the longitudinal position of the sleeve 104 relative to the base 102 and the height of the remaining portion of the stick 106.

The base 102 has on the front and rear major surfaces a respective ratchet mechanism 109 comprising a resilient member 112 which engages with a longitudinally oriented series of horizontal slots 110 provided in an adjacent surface of the sleeve 104. As for the second embodiment, the opposite ratchet mechanisms 109 restrict downward movement of the sleeve 104 against the resilience of the resilient member 112 which are each received within respective opposed slots 110.

Figure 11:
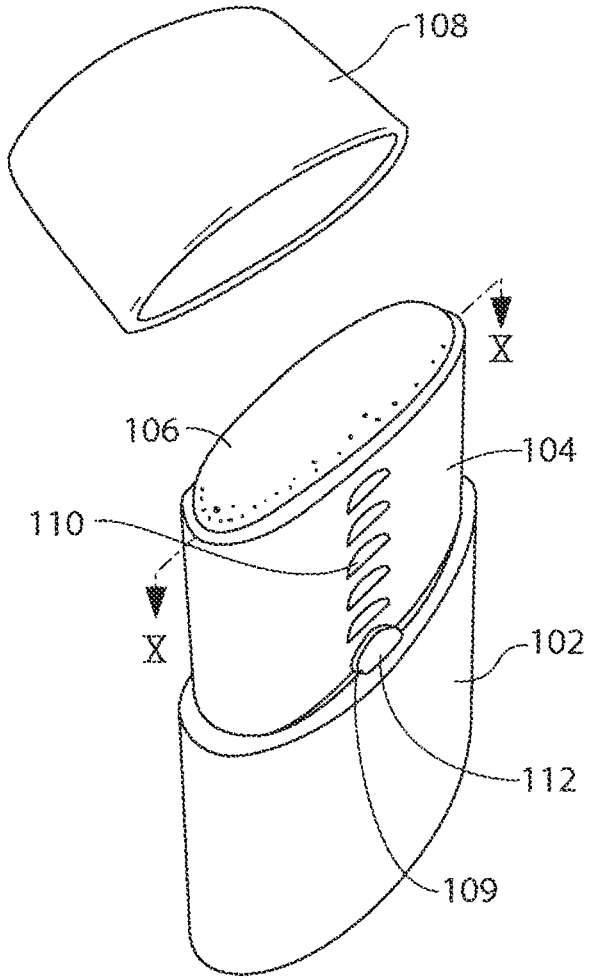
FIG. 11 schematically illustrates a perspective view of the assembled package, with the cap thereof removed, of FIG. 9.
Figure 12:
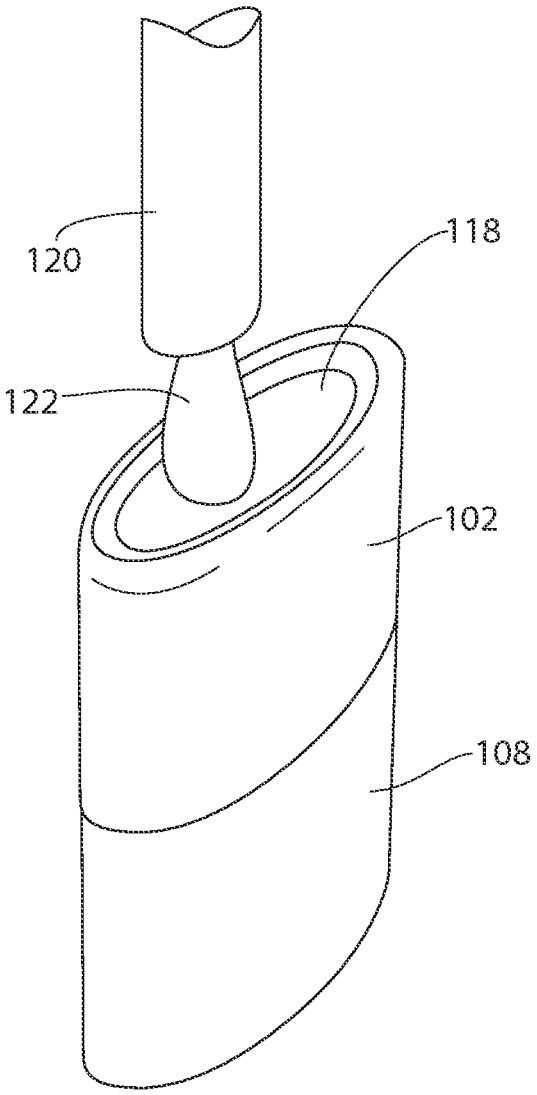
FIG. 12 schematically illustrates the package of FIG. 11 when inverted and during a filling step in which the package is filled with consumer care composition in liquid form.

When a user wishes to retract the sleeve, for the reasons described with respect to the second embodiment, the sleeve 104 can be pushed manually downwardly against the resistance of the opposed ratchet mechanisms 109, as shown by the arrows D in FIG. 11 and then located at a desired retracted indexed position to expose the required height of the stick 106. The opposed resilient members 112 are received within respective opposed slots 110 of the sleeve 104 so that the ratchet mechanisms 109 support the sleeve 104 at the desired height during use. The sleeve 104 can readily be raised manually to a desired extended position to protect the stick 106, the ratchet mechanisms 109 readily permitting upward movement of the sleeve 104 with minimum resistance force.

The package 100 can be inverted and filled with liquid a measured dose of the required volume of the consumer care composition during manufacture in the same manner as described with respect to the first embodiment. The base inner part 114 has a porous upper wall 116 through which liquid consumer care composition 122 can flow after being injected into the central cavity 118 of the base inner part 114 from a nozzle 120. Subsequently, as for the first embodiment a plug (not shown) may be fitted to the base 102 to seal the cavity 118.

In a modified embodiment, only a single ratchet mechanism is provided at one major surface, such as the front, of the package.

The packages of the various embodiments of the present invention can have desired external shape and dimensions to provide an attractive and distinctive aesthetic appearance for visual impact of the package to the purchaser in a retail environment.

In each of the various embodiments of the present invention, the provision of a base inner part which has a porous transverse wall results in a lower portion of the solid stick consumer care composition being located at the top of an internal central cavity of the base, and spaced from the bottom surface of the package. When the consumer care composition contains a fragrance, as is conventional, the central cavity becomes infused with the fragrance.

Figure 10:
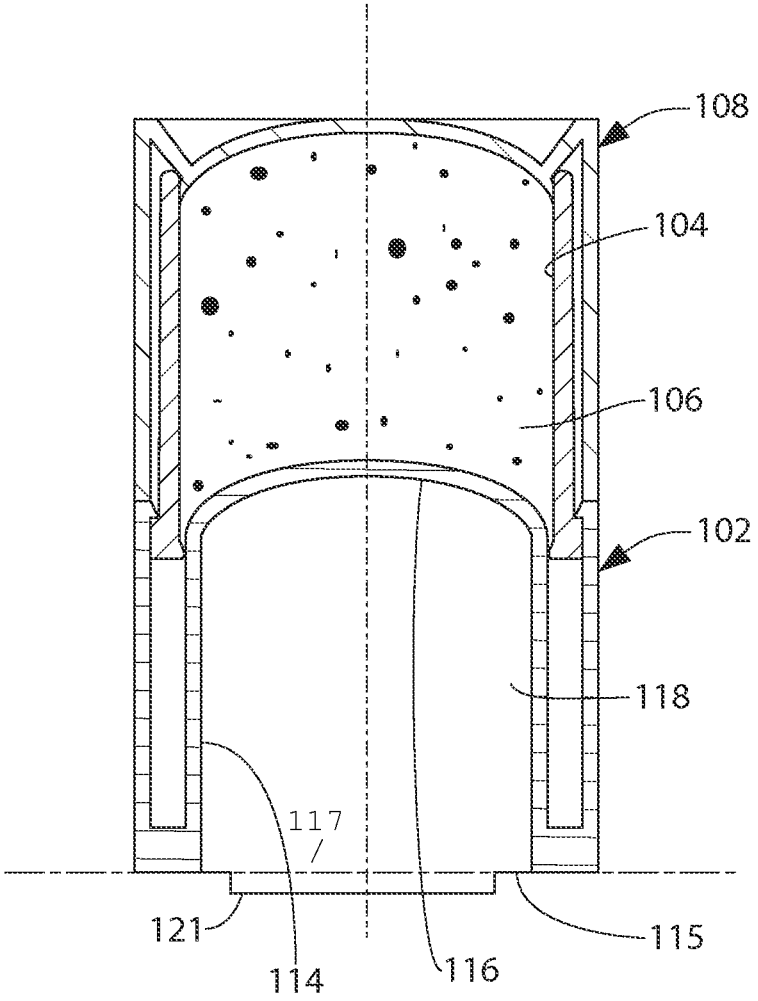
FIG. 10 schematically illustrates a section through the assembled package of FIG. 9.

As shown for example in FIG. 10, although a similar construction may be provided for each embodiment, the bottom wall 115, or plug if present, may be provided with at least one selectively openable conduit 117 communicating with the central cavity 118 beneath the porous transverse wall 116 on which the stick 106 is mounted. When the at least one conduit 117 is sealed, the central cavity 118 is sealed with the infused fragrance therein. When the at least one conduit 117 is opened, the central cavity 118 becomes in communication with the exterior of the package, to permit the consumer, prior to purchase of the product, to sample the fragrance of the packaged consumer care composition.

Various removable or openable sealing mechanisms may be employed. For example, the conduit may be provided in the sealing plug and a removable pressure-sensitive self-adhesive label 121 is adhered over the conduit to seal the cavity, as shown in FIG. 10. Removal of the self-adhesive label 121 reveals the at least one conduit 117 and permits the fragrance within the central cavity 118 to propagate to the exterior of the package via the at least one conduit 117. Other temporary sealing mechanisms, such as valve mechanisms, openable conduits, etc. will be readily apparent to the skilled person.

Various other modifications to the disclosed embodiments will be apparent to those skilled in the art.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

What is claimed is:

1. A package for a consumer care composition, the package comprising a container containing a consumer care composition in the form of a solid stick, the container having a base, a solid stick of the consumer care composition supported on the base at a fixed longitudinal position, an annular sleeve surrounding the solid stick, the annular sleeve being coupled to the base by a coupling mechanism, the coupling mechanism being adapted to control longitudinal movement of the annular sleeve relative to the base between extended and retracted positions, wherein the base includes a cavity for receiving the sleeve in the retracted position, wherein the cavity is an annular cavity between the base and an inner part, wherein the base comprises a transverse wall on which the solid stick is mounted, wherein the transverse wall is porous and disposed above a central cavity within the base, wherein the consumer care composition includes a fragrance, and further wherein the package comprises at least one selectively openable conduit communicating with a region including the consumer care composition.

2. The package according to claim 1 wherein the annular sleeve is longitudinally movable relative to the base by rotation of the annular sleeve.

3. The package according to claim 2 wherein the coupling mechanism comprises a threaded connection between the annular sleeve and the base.

4. The package according to claim 3 wherein the threaded connection comprises a male thread provided on an exterior surface of the annular sleeve and a female thread provided on an internal surface of the base.

5. The package according to claim 4 further comprising a grip enhancing exterior surface of the annular sleeve.

6. The package according to claim 1 wherein the annular sleeve is longitudinally movable relative to the base by longitudinal sliding translation of the annular sleeve.

7. The package according to claim 6 wherein the coupling mechanism comprises at least one ratchet mechanism between the annular sleeve and the base.

8. The package according to claim 7 wherein the at least one ratchet mechanism comprises a resilient member on the base and a plurality of slots on an exterior surface of the annular sleeve, the resilient member being selectively locatable in a respective one of the plurality of slots.

9. The package according to claim 8 wherein the plurality of slots are oriented along a longitudinally directed line.

10. The package according to claim 9 comprising two opposed ratchet mechanisms.

11. The package according to claim 9 wherein the resilient member comprises an upwardly oriented resilient plate located at an upper edge of the base, the plate having a free end for interlocking with a respective slot and being connected to the base by a living hinge.

12. The package according to claim 1, wherein the at least one selectively openable conduit communicates with a central cavity in the base beneath the consumer care composition.

13. The package according to claim 12 wherein the at least one selectively openable conduit is temporarily sealed by a removable pressure-sensitive self-adhesive label adhered thereover.

14. A package for a consumer care composition, the package comprising a container containing a consumer care composition in the form of a solid stick, the container having a base which comprises a transverse wall on which the solid stick is mounted at a fixed longitudinal position, the transverse wall being porous and disposed above a central cavity within the base, the central cavity being surrounded by an inner side wall of the base, the base further comprising an outer side wall defining an annular cavity between the outer side wall and the inner side wall, a sleeve surrounding the solid stick, the sleeve being longitudinally movable relative to the base between extended and retracted positions, the sleeve being retractable into the annular cavity, wherein the consumer care composition includes a fragrance, and wherein the package comprises at least one selectively openable conduit communicating with the central cavity.

15. The package according to claim 14 further comprising a plug sealing the bottom of the central cavity.

16. The package according to claim 14, wherein the consumer care composition is an antiperspirant composition and/or a deodorant composition.

17. The package according to claim 16 further comprising a cap fitted to the base.

18. A package for a consumer care composition, consisting essentially of:

a consumer care composition;

a base to support the consumer care composition at a fixed longitudinal position;

a movable annular sleeve, configured to surround the consumer care composition and to move longitudinally relative to the base between extended and retracted positions; and a removable cap to engage with the base and to cover the consumer care composition and the movable annular sleeve, wherein the base defines an annular cavity to receive the movable annular sleeve when retracted, and wherein the base defines a central cavity and a porous upper transverse wall to support the consumer care composition, and wherein the base comprises at least one of a plug and a selectively openable conduit to control access to the central cavity.

19. The package of claim 18, wherein the consumer care composition is loaded into the package through the central cavity and the porous upper transverse wall.

20. The package of claim 18, wherein the movable annular sleeve and the annular cavity of the base comprise helical threads, and a longitudinal movement of the movable annular sleeve is controlled by a rotation of the movable annular sleeve about a longitudinal axis.

21. The package of claim 18, wherein the movable annular sleeve comprises ratchet slots, and the base comprises a ratchet mechanism, and wherein a downward movement of the movable annular sleeve is restricted by the ratchet mechanism.

* * * * *